US005811711A

United States Patent [19]

Tremblay et al.

[11] Patent Number: 5,811,711

[45] Date of Patent: Sep. 22, 1998

[54] METERED DELIVERY OF EXPLOSIVES

[75] Inventors: Dennis Adelard Tremblay, Schnecksville; Robert Grenfell Adams, Allentown, both of Pa.

[73] Assignee: ICI Canada Inc., North York, Canada

[21] Appl. No.: 736,632

[22] Filed: Oct. 23, 1996

Related U.S. Application Data

[63] Continuation of Ser. No. 452,844, May 30, 1995, abandoned.

[51] Int. Cl.[6] ..... F42D 1/10

[52] U.S. Cl. ..... 86/20.15

[58] Field of Search ..... 86/20.12, 20.15, 86/21

[56] References Cited

U.S. PATENT DOCUMENTS

| | | | |
|---|---|---|---|
| 3,303,738 | 2/1967 | Clay et al. | 86/20 |
| 3,380,333 | 4/1968 | Clay et al. | 86/20 |
| 4,195,548 | 4/1980 | Cook et al. | 86/1 R |
| 4,508,035 | 4/1985 | Mashimo et al. | 102/313 |
| 4,685,375 | 8/1987 | Ross et al. | 86/20.15 |
| 4,966,077 | 10/1990 | Halliday et al. | 102/313 |
| 5,447,090 | 9/1995 | Adams | 86/20.15 |

*Primary Examiner*—Charles Jordan
*Assistant Examiner*—John R. Hardee

[57] ABSTRACT

The present invention is directed to a metered delivery of explosives to boreholes in mining, quarrying, and/or construction operations. The explosives may be ANFO, emulsions, bulk explosives, packaged explosives, blends thereof, and combinations thereof.

6 Claims, 2 Drawing Sheets

METERED DELIVERY OF EXPLOSIVES

This is a continuation, of application Ser. No. 08/452,844 filed on May 30, 1995, now abandoned.

BACKGROUND OF THE INVENTION

The present invention is directed to the metered delivery of explosives to boreholes in mining, quarrying, and/or construction operations.

In present mining, quarrying, and/or construction operations, such sites are prepared by first designing the blast site, then drilling boreholes, as appropriate, consistent with the engineered design, and finally filling the boreholes with explosives and initiating/detonating the blast design. A variety of engineering techniques are used to implement the blast design to insure that a complete blast is effected.

In the past and in the present, such above cited operations have been and are dimly viewed by some since wastage and spillage of explosive materials is invariably part of the operations. For example, a common bulk explosive, ammonium nitrate combined with fuel oil ("ANFO") may be mixed with an emulsion or a blend of these components. The emulsion generally has the consistency of mayonnaise so that it is flowable, and thus spillable. Since tons of these explosives are used annually, spillage can result in economic waste as well as environmental harm. Therefore, a problem in this art is the efficient delivery of explosives to its final destination.

The delivery of explosives has generally been operator controlled at the delivery site. The explosive is loaded into a container on a delivery truck, transported to the field where boreholes have been previously drilled and the explosive delivered into the borehole by delivering the explosive through a delivery hose. The filling of the borehole is completed dependent upon the discretion of the operator who must judge when the borehole has been sufficiently filled with explosive. Reaction times of operators vary and there is bound to be waste and spillage due to human error.

The present invention provides for the metered delivery of explosives thus substantially decreasing the waste and spillage of bulk explosives at the site of delivery. This metered delivery may be used for emulsion explosives, ANFO, packaged or bulk explosives, and blends thereof.

SUMMARY OF THE INVENTION

An apparatus for metering the delivery of explosives comprising a control panel, a programmable means for setting delivery quantities of said explosives, a timing means for actuating and arresting the delivery of said quantities of explosives, a metering means for measuring the quantities of explosives delivered whereby said explosives can be measurably delivered to a borehole.

The apparatus is run by an electrical resource which is preferably a low voltage, about 12 volts direct current. The control panel is part of the apparatus said apparatus is positioned on the explosives delivery means which can be a truck, reservoir, and/or trailer containing explosives. The control panel is provided with an input means to input data related to the volume of the borehole. The borehole volume is generally defined by the size of the drill and the depth of the borehole. This definition provides the minimum data necessary to predictably estimate the volume of the borehole. This estimated volume is the basis for calculating the quantity of explosives that needs to be delivered to each borehole.

Typically, boreholes are loaded with explosives to a collar, the collar comprising the void space from the surface of the ground to the top of the explosives fill level in the borehole. The remaining portion of the borehole is filled with explosives which has been fit with an initiation means in order to detonate the explosives. Accordingly, the volume to be metered for explosive delivery is the lower portion of the borehole.

Knowing the volume to be metered then requires input of the relevant data into the apparatus. The volume requirements are used as part of the basis for calculating the timing needed to deliver the metered explosive quantity. An additional basis for the timing calculation is the density of the explosive to be delivered. As those skilled in this art will appreciate, the calculation is performed by determining the mass from the density equation and determining the time from the velocity/mass equation for moving mass from point A to point B. As a result, any explosive that may be moved in this manner is capable of being delivered in a metered delivery system similar to the present invention.

Explosives that may be delivered in this system are emulsions, blends of emulsions and/or ANFO, ANFO, and other blasting agents. The most preferable explosive is ANFO.

The control panel comprises several functions. A function must be available for inputting data, for receiving a remote signal either wired or RF (remote radio frequency), stop override, a volt meter to indicate voltage to the panel, initiate product delivery, and a blow-out function. The data input function has been disclosed hereinabove.

The optional reception of remote signal is a convenience to the operator. Firstly, it removes the operator from actuating the delivery means at the explosive reservoir so that attention may be paid to the borehole loading operation. Secondly, it provides a safety net for the operator for a host of mechanical reasons. Finally, remote control of the delivery means may be more convenient.

As a safety measure, a stop override is provided for unforeseen complications in the delivery operations. This, again, is for the convenience as well as the safety of the loading operator.

The volt meter is optionally included to insure that voltage input from the electric source is consistent. The source of electricity may be any convenient source but is most preferred as a 12 volt direct current source.

The blow out function is important as a means to insure that the borehole is cleared of water and/or minor drilling debris. This blow out is performed prior to filling with the explosives. Optionally, the apparatus may be provided with additional readouts such as total explosives delivered and/or other data collection activities, for the convenience of the operator.

The timing means is actuated by the start signal and communicates with the programming means. The programming means then actuates a solenoid which switches the valving mechanism to open the valve for explosives delivery and close as appropriate. A second solenoid activates the air blow-out or hose clearing operation which may optionally be actuated by the timing means. The programming means then feeds back through the timing means once the cut-off or arrest of explosives delivery is signaled through the metering means. Once signaled as a cut-off the timing means terminates delivery of the explosive and optionally, begins the timed delivery of air as a clearing means for the delivery hose. As another option, the start signal from the programming means allows a flow of air through the delivery hose to clear any water and/or drilling debris from the borehole. These options may be discretionally directed by the operator through the apparatus.

Metering of the explosives is provided by the timed flow or delivery of the explosives. The communication between the programming means and timing means controls the volume of explosives metered through the delivery hose. As cited above, the mass delivered is dependent upon density of the explosive and the emptied volume of the borehole. As those skilled in this art know, the flow of explosives into the borehole will vary with the type of explosive used, since each explosive will have its own density. The criticality of this feature of the explosive is well-decided in advance of operator delivery, since this density value will be part of the engineered blast design as will be the emptied volume of the borehole. Knowing the metering rate, inherently provides a measure of the quantity of explosives delivered, thereby providing the overall operation with information related to the overall blast characteristics. Ultimately, such metering is responsible for the resultant economic and environmental husbandry.

DETAILED DESCRIPTION OF THE INVENTION

The following description is presented to further illustrate the novel aspects of the present invention and are not intended to limit the scope of the invention to any particular embodiment.

Figure 1:
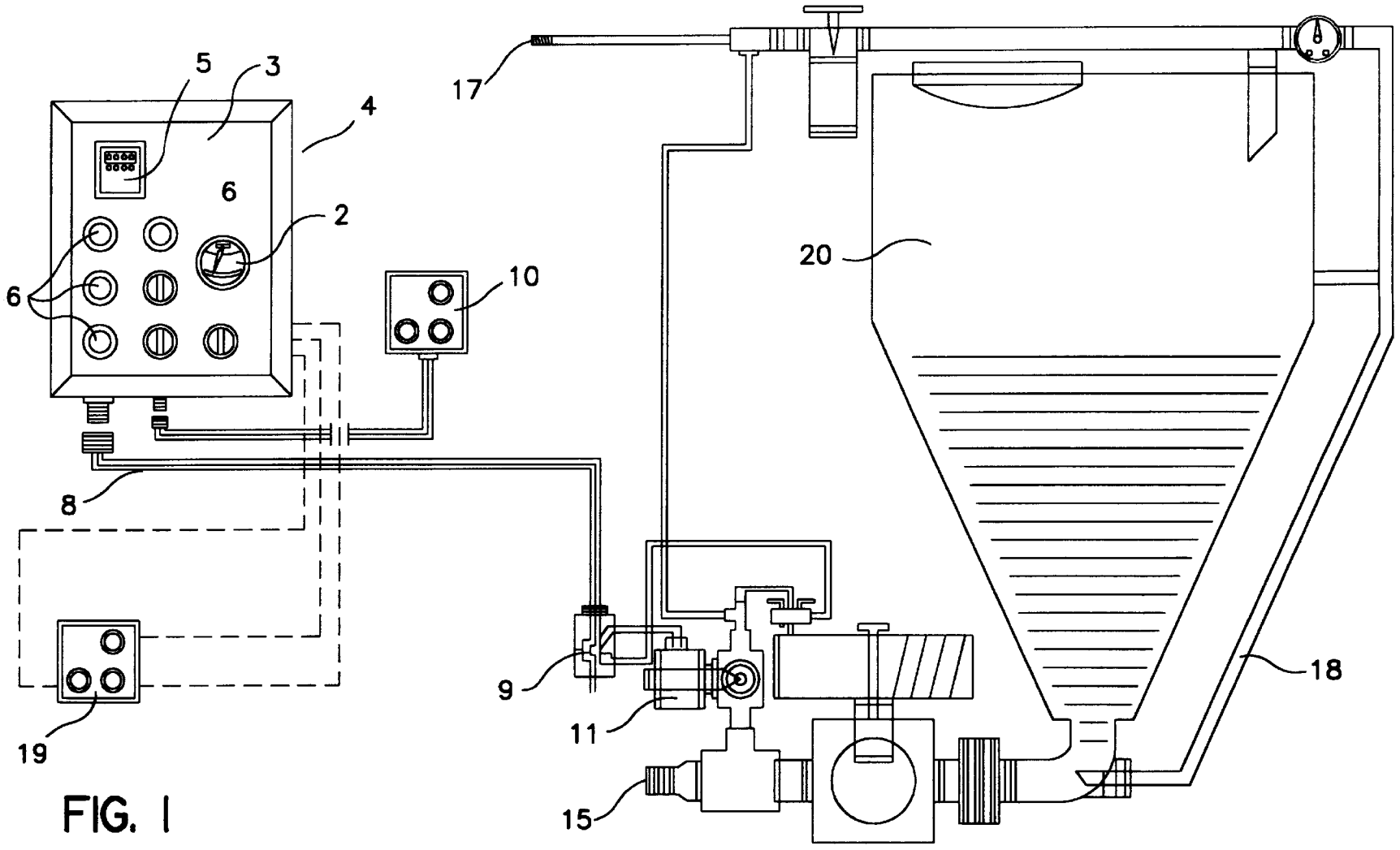
FIG. 1 is a systems drawing showing the apparatus and its relationship to the reservoir, pumps, and remote controls.

Referring to FIG. 1, 4 is the apparatus with control panel, 3, comprising volt meter, 2, to monitor voltage characteristics of the apparatus. Meter, 5, totals the throughput of explosives, and 6 refers to various control 5 buttons on the control panel. Element 10 is a remote control means which may be either RF controlled or by wired transmitter hook-up. The apparatus is connected to the reservoir by element 8, which actuates solenoid, 9, which then activates flow means, 11. The explosives outlet hose is connected at 15 which is an outlet from reservoir 20. Inlet 17 is for the input of air which may be mixed in combination or as a stream of air by element 18. The air flow may be optionally controlled by remote by element 19.

Figure 2:
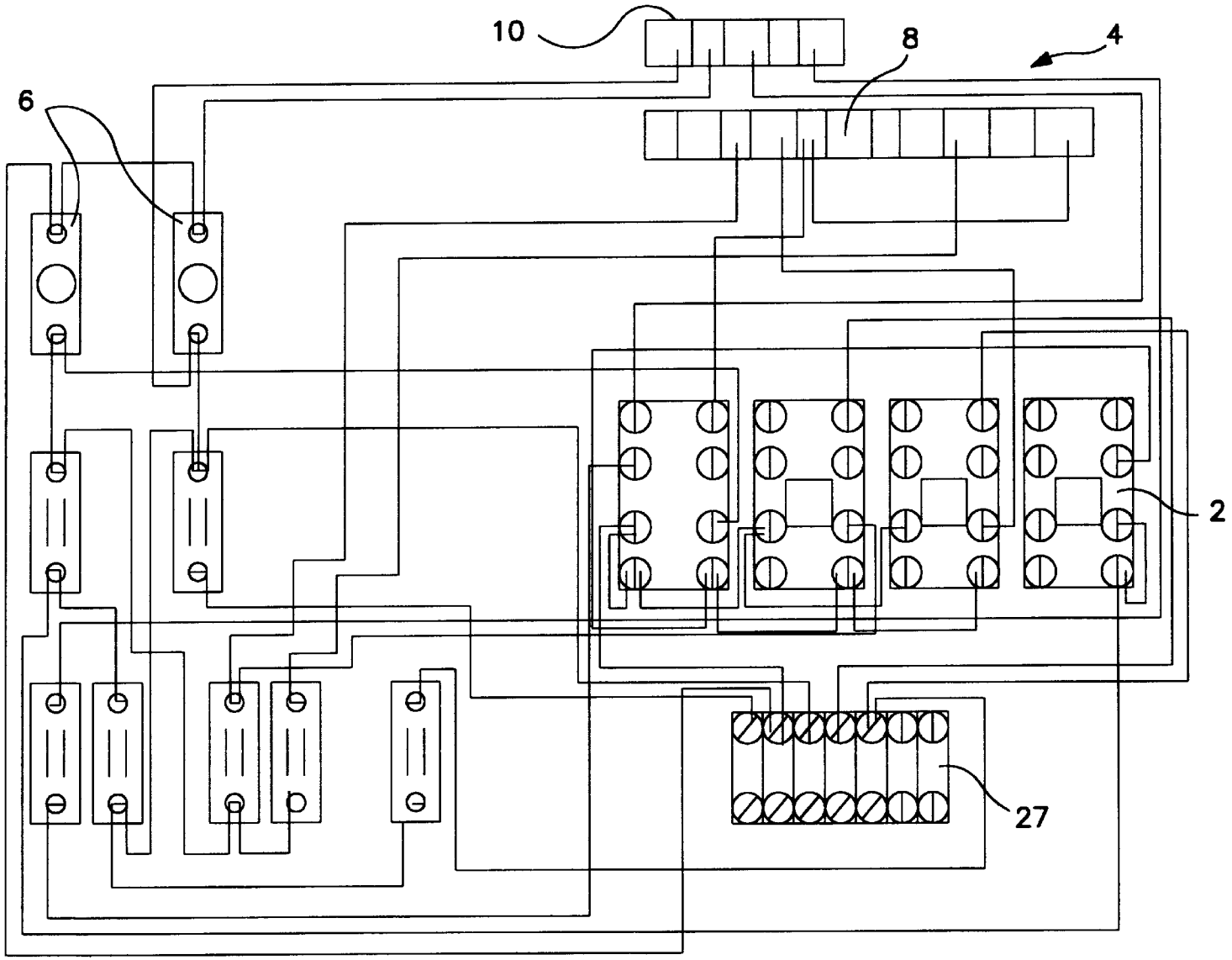
FIG. 2 is a schematic drawing showing the electrical connections within the apparatus.

FIG. 2 shows the schematic of the apparatus which shows the connection of the control buttons, 6, to the output control means at 8 and 10. The switches or control buttons are timely controlled by relays 25, said relays timed to perform as programmed in element 27. Element 27 is standard "off the shelf" electronics.

I claim:

1. Apparatus for delivering a metered quantity of an explosive emulsion to a borehole, the apparatus comprising:

a) a bulk emulsion container;

b) a gas source;

c) a metering means connected to the bulk container and to the gas source, the metering means including a delivery hose;

d) a control means connected to the metering means;

e) a programmable controller connected to said delivery means, the programmable controller comprising:

1. a data input means for inputing data relating to the volume of the borehole and for inputing data related to the density of the emulsion;

2. a calculating means for calculating a volume of emulsion sufficient to fill a predetermined percentage of the borehole volume;

3. a timing means for sequentially actuating said metering means a first time to direct a first stream of gas from the gas source through said delivery hose into the borehole for a first preset time period and for actuating said metering means a second time for a time period sufficient to deliver said calculated volume of emulsion through said delivery hose into the borehole; and f) actuating means connected to the programmable controller for turning the controller on and off.

2. Apparatus according to claim 1 wherein the timing means actuate said metering means a third time to direct a second stream of gas for a second, preset, time period from the gas source into the delivery hose to completely discharge any remaining emulsion in the delivery hose.

3. Apparatus according to claim 1 wherein the gas is air.

4. Apparatus according to claim 1 wherein the actuating means comprises a remote actuating means.

5. Apparatus according to claim 4 wherein the remote actuating means comprises a receiver for receiving a remote radio frequency signal.

6. Apparatus according to claim 1 wherein the calculating means calculate the volume of the emulsion to be metered by subtracting from the borehole volume a preset percentage of the borehole volume corresponding to a collar portion of the borehole.

* * * * *